US011352801B2

(12) United States Patent
Ojeda

(10) Patent No.: US 11,352,801 B2
(45) Date of Patent: Jun. 7, 2022

(54) TOOL FOR INSTALLATION OF FLOORING OR SIDING

(71) Applicant: Christopher Ojeda, Charleston, WV (US)

(72) Inventor: Christopher Ojeda, Charleston, WV (US)

( * ) Notice: Subject to any disclaimer, the term of this patent is extended or adjusted under 35 U.S.C. 154(b) by 256 days.

(21) Appl. No.: 16/515,095

(22) Filed: Jul. 18, 2019

(65) Prior Publication Data

US 2021/0017773 A1 Jan. 21, 2021

(51) Int. Cl.
*E04F 21/22* (2006.01)

(52) U.S. Cl.
CPC ..... *E04F 21/22* (2013.01)

(58) Field of Classification Search
CPC ..... B23Q 9/0078; E04F 21/22; B25B 5/068
USPC ..... 254/51
See application file for complete search history.

(56) References Cited

U.S. PATENT DOCUMENTS 832,516 A * 10/1906 Williams ..... E04F 21/22 254/17
1,242,623 A * 10/1917 West ..... E04F 21/22 254/17
2011/0101289 A1* 5/2011 Lee ..... E04F 21/22 254/103

FOREIGN PATENT DOCUMENTS

GB 879804 A * 10/1961 ..... B44C 7/02
GB 932305 A * 7/1963 ..... E04F 21/22

* cited by examiner

*Primary Examiner* — Babajide A Demuren
(74) *Attorney, Agent, or Firm* — York Law LLC; Olen L. York, III

(57) ABSTRACT

A tool utilized for installing flooring and/or siding, the tool providing a tighter junction between margins of the flooring and/or siding through a tool head having a radius that is used to urge the flooring or siding margins into position. The tool is secured to a subsurface and rotated to manually manipulate the radius along the margin of the flooring or siding to cause the material to move into proper installation position, regardless of the uneven and/or warped nature of the material.

9 Claims, 7 Drawing Sheets

TOOL FOR INSTALLATION OF FLOORING OR SIDING

FIELD OF THE INVENTION

This invention relates to a tool, and more particularly to an installation tool.

BACKGROUND OF THE INVENTION

Due to the nature of harvesting and cutting trees, wood boards often warp. This causes several problems for the construction industry, in particular, increasing the time and effort invested in finding substantially straight and/or flat boards for building walls and/or installing flooring or siding. Many apparatuses and devices have been proposed and attempted to utilize non-linear boards, including U.S. Pat. Nos. 14,676, 81,803, 299,220, 302,416, 375,147, 376,439, 460,790, 764,128, 797,245, 975,566, 1,231,461, 1,354,854, 2,589,404, 2,780,437, 3,524,623, 3,779,515, 4,620,691, 5,248,127, D353,987, 5,527,014, many of which require anchoring of the device using a wench-like mechanism for cranking-and-drawing the warped board into a linear alignment.

A variety of different force-generating mechanisms have been attempted. For example, U.S. Pat. No. 10,061 issued to Parrish for a "Floor Clamp" utilizes a screw-type action; U.S. Pat. No. 136,428 issued to Foster for "Floor Clamps" utilizes rack-and-pinion action; while U.S. Pat. No. 3,143,335 issued to Lassahn for "Clamping Device for Constructing Flooring, Decking and the Like" utilizes hydraulic force. Each of these examples used a device that exerted force against the floor joists.

Most recent, additional rack-and-pinion gear type levering handle devices have been developed and offered. U.S. Pat. No. 8,708,310 issued to Edgerly and U.S. Pat. No. 8,434,738 issued to Anstett each have the rack-and-pinion drive. U.S. Pat. Application No. 20080236093 (filed by Coleman) also discloses a rack-and-pinion gear with levering handle and ram pushing plate.

Other recent efforts include U.S. Pat. No. 6,962,179 issued to Brodersen for a "Floor Jack" discloses a device having a handle, a spur (for placement on a joist), and a push arm and head. Another example may be found in U.S. Pat. No. 7,121,528 issued to Mikkelson, which discloses a flat work piece that fits with and rides along an installed section of flooring, the work piece having a handle and an end, wherein the handle is used to move the work piece into engagement with an uninstalled section of flooring or material.

Commercially of note, Powernail Co. Inc. currently markets two models of a flooring jack called a Powerjack™. Both devices use a ratchet mechanism to exert force on flooring. The Powerjack 100 includes a bent leg that hooks over the edge of the tongue-in-groove flooring as well as a flat press-foot articulated by a ratchet. The unit rides on the flooring to be moved, while the press-foot pushes against a stationary object such as a wall or a stud nailed to the subfloor, thereby pulling the flooring into place. Alternatively, the Powerjack 200 is designed for glue down and gym floor installation by pushing from a subfloor anchor point. It has a flat-foot which must be attached by nails or screws to the subfloor, and a second foot that may be moved by a ratchet to press against the tongue-in-groove flooring.

Although many devices have been offered in an attempt to provide a simple and efficient manner to install imperfect construction material, the identified means, including specific invention disclosures and other related innovations, have been ineffective in this regard.

SUMMARY OF THE INVENTION

It has been observed that the use of a tool with a cam feature is useful for installing flooring and/or siding that is uneven, crooked, and/or warped. Accordingly, the tool disclosed and described herein comprises elements and components that improves the installation fit and speed at which installation of flooring and/or siding may be achieved.

In one embodiment of the tool disclosed and described herein, a tool comprises a head having a radius, the radius including a channel formed therein, with an anchor means formed in the head. The tool also includes means for rotating the head about anchor means. In one such embodiment, the head comprises an oval-shape with anchor means centered within the head area. In another such embodiment, the head comprises a circular-configuration with anchor means eccentric and off-center relative to the head area.

In another embodiment of the tool disclosed and described herein, a tool comprises a head having a radius that includes a channel formed therein, anchor means eccentric to the radius formed in the head, and a lever depending from the head. The channel comprises a floor intermediately disposed between a first side wall and a second side wall. The channel may further comprise a ramp in communication with the floor and the first and second side walls. Moreover, the tool may further comprise a base depending from the lever, wherein the base includes a cavity and a grip selectively attachable and detachable within in the cavity.

In another embodiment of the tool disclosed and described herein, a tool comprise a body having a head, a base, and a lever intermediately disposed between the head and the base, a radius formed along the head and a channel formed within the radius, and anchor means formed on the head and eccentric to the radius.

In such an embodiment, a tool comprising a body having a head, a base, and lever intermediately disposed between the head and base, the channel comprises a floor intermediately disposed between a first side wall and a second side wall. In a related embodiment, the channel further comprises a front ramp in communication with the floor and the first and second side walls. In another related embodiment, the channel further comprises a rear ramp in communication with the floor and the first and second side walls.

In such an embodiment, a tool comprising a body having a head, a base, and lever intermediately disposed between the head and base, anchor means comprises an aperture for securing the tool to a surface via a fastener.

In such an embodiment, a tool comprising a body having a head, a base, and lever intermediately disposed between the head and base, the base comprises a cavity. Moreover, the tool further comprises a grip selectively attachable and detachable to the cavity. In one embodiment of the tool comprising the grip, the tool further comprises the cavity including a plurality of threads, the grip including a plurality of threads, and wherein, the plurality of threads of the cavity and the plurality of threads of the grip are threadably mated and unmated to provide selective attachment and detachment of the grip and the cavity. In another embodiment of the tool comprising the grip, the tool further comprises the cavity including first dimples and second dimples, the first dimples and the second dimples oriented at different depths of the cavity, and the first dimples oriented approximately 90 degrees from the second dimples, with the grip including a depressible button linked with a stem including outwardly biased bearings, the first dimples disposed within the cavity to receive and retain the bearings for the grip inserted through an upper side of the tool, and the second dimples disposed within the cavity to receive and retain the bearings for the grip inserted through a lower side of the tool. In another embodiment of the tool comprising the grip, the tool further comprises the grip including an axle and flanges on each end of the axle, the cavity including a void and recesses on each end of the void, the recesses comprising a larger diameter than the void, and wherein the void accommodates the axle and the recesses accommodate the flanges, and wherein the axle travels through the void and is adapted for adjustment of the grip to achieve an upper side orientation or a lower side orientation.

In such an embodiment, a tool comprising a body having a head, a base, and lever intermediately disposed between the head and base, the head comprises a hook-shaped end. Moreover, the tool may further comprise the head including slot formed near the hook-shaped end.

In such an embodiment, a tool comprising a body having a head, a base, and lever intermediately disposed between the head and base, the lever is curvilinear relative to the head.

DESCRIPTION OF THE EMBODIMENT(S)

It will be readily understood that the components of the present invention, as generally described and illustrated in the figures herein, may be arranged and designed in a wide variety of different configurations. Thus, the following detailed description of the embodiments as represented in the attached figures, is not intended to limit the scope of the invention as claimed but is merely representative of selected embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

Figure 1A:
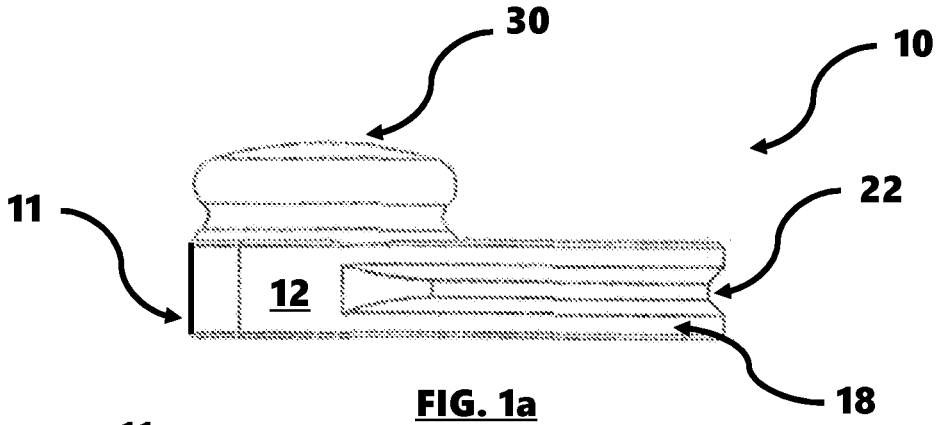
FIGS. 1*a*-1*c* depict multiple views of one embodiment of an installation tool having a head, non-concentric anchor means, and means for rotating the head about anchor means.
Figure 1B:
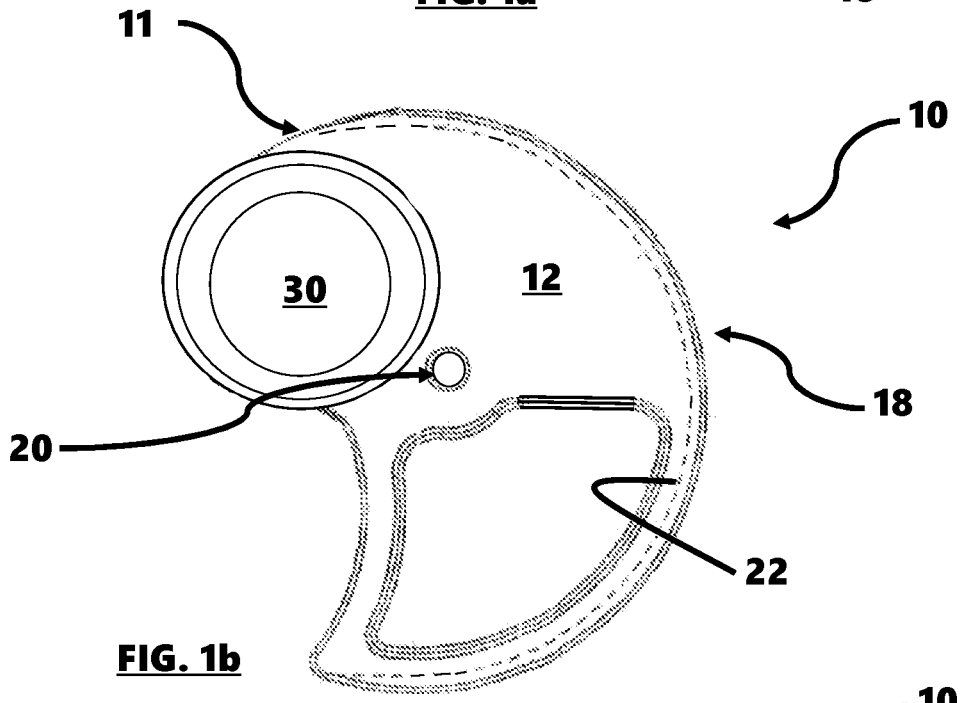
Figure 1C:
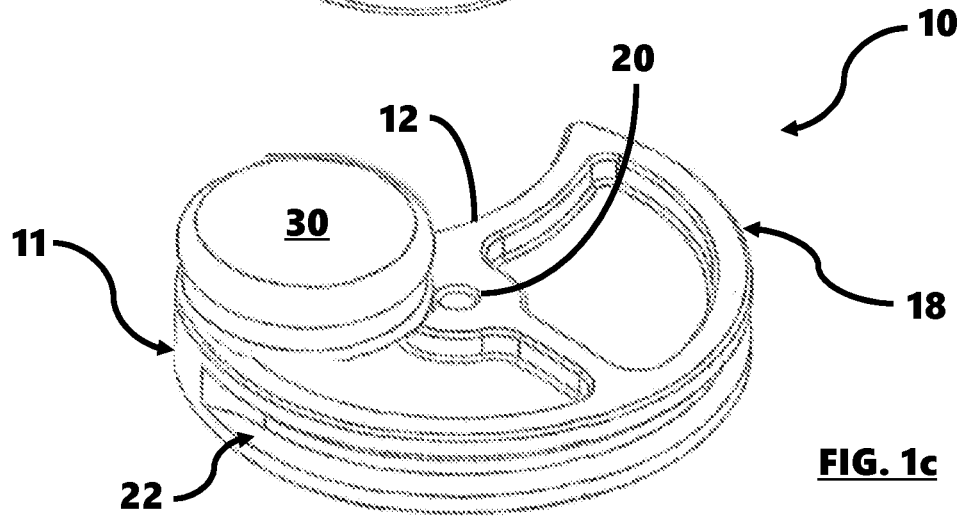
Figure 2A:
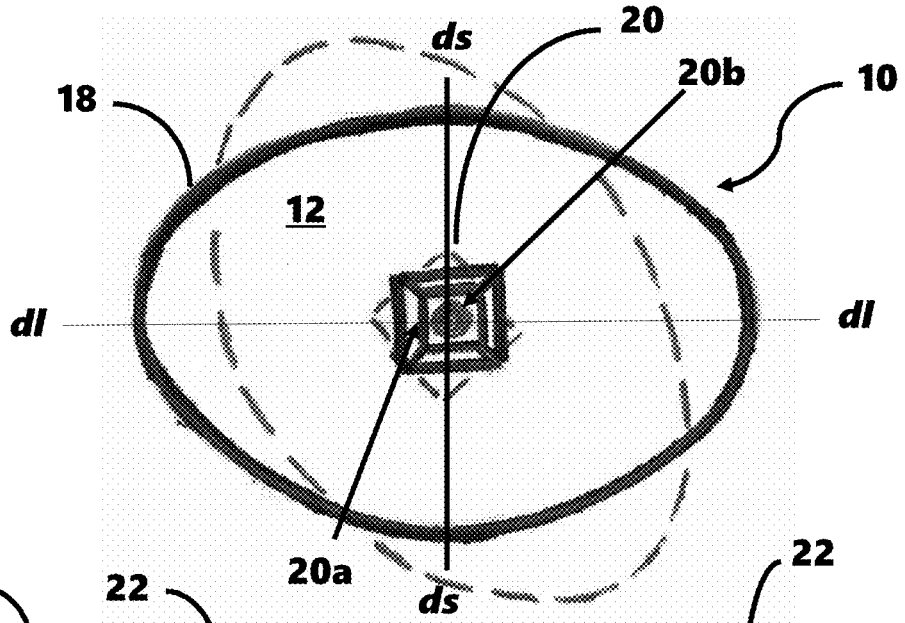
FIGS. 2*a*-2*c* depict multiple views of an alternative embodiment of an installation tool having a head with an oval-shaped configuration, a concentric anchor means, and a first bore and second bore within anchor means to secure and rotate the head about anchor means.
Figure 2B:
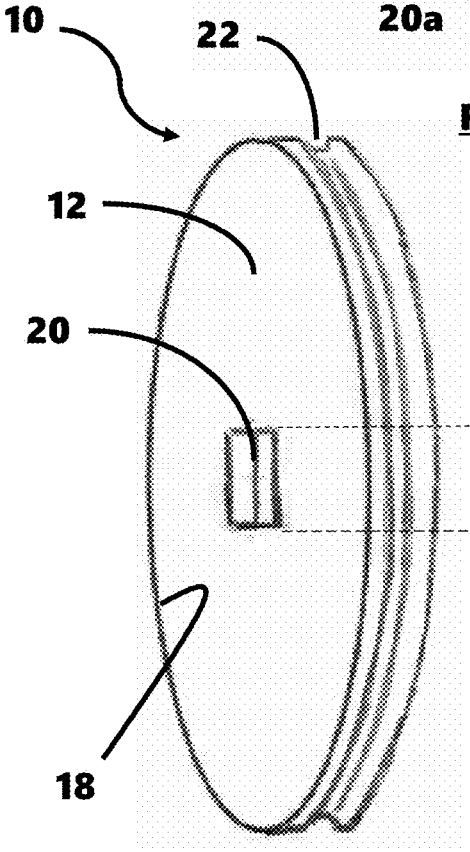
Figure 2C:
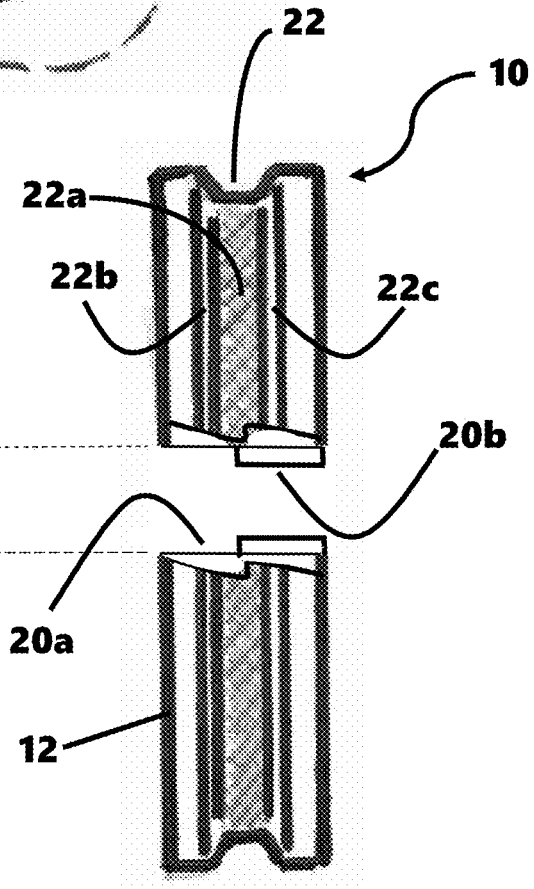
Figure 3A:
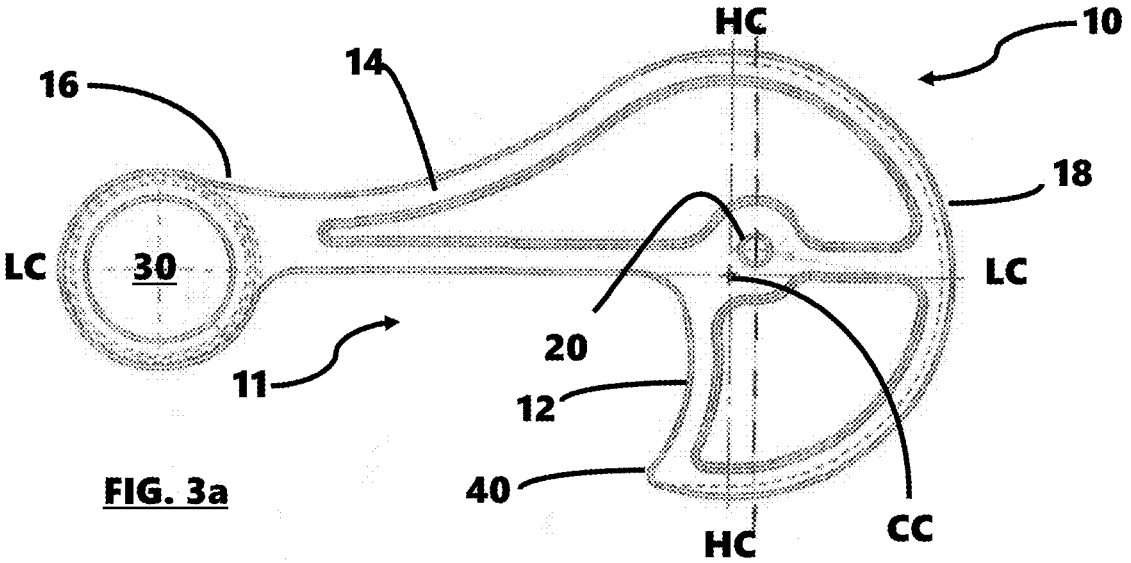
FIG. 3*a* depicts a plan view of one embodiment of an installation tool having a lever intermediately disposed between a head and an opposing base.
Figure 3B:
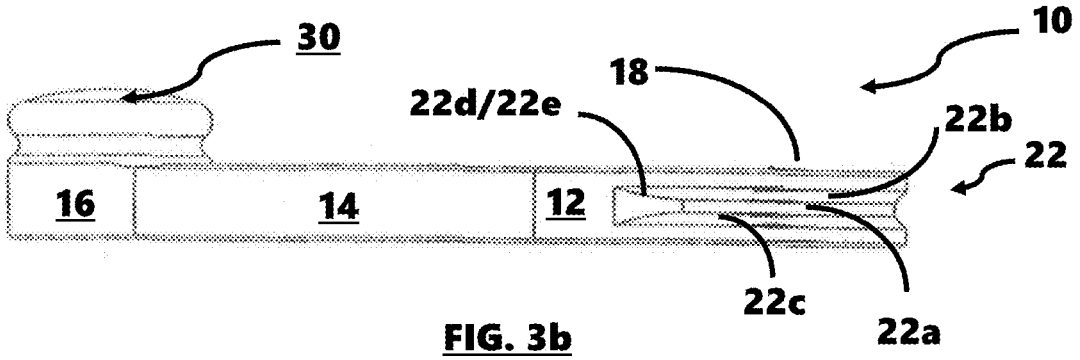
FIG. 3*b* depicts a side view of the tool depicted in in FIG. 2.
Figure 4:
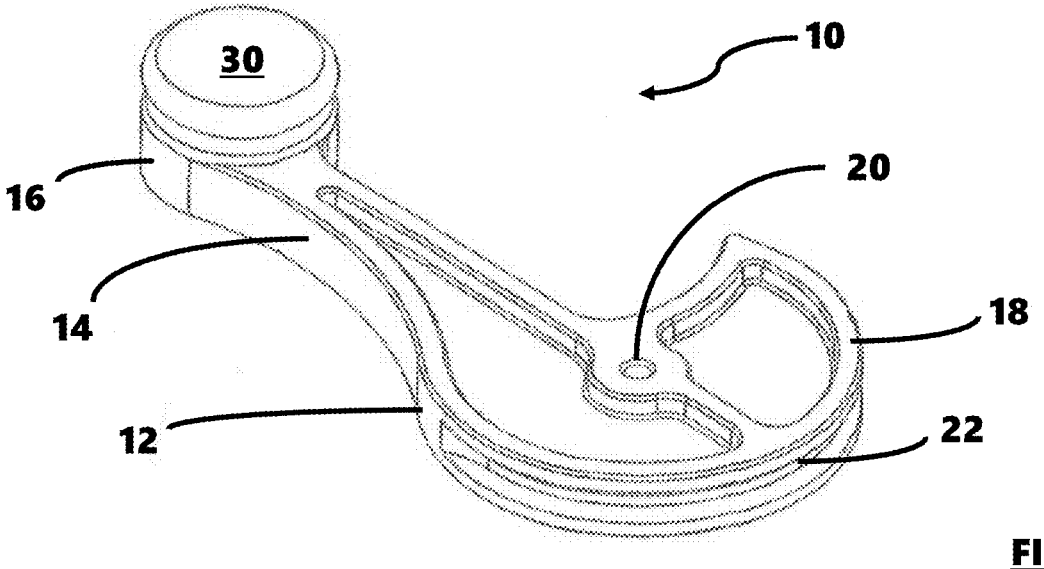
FIG. 4 depicts an isometric view of the tool depicted in FIGS. 2 and 3.

In accordance with FIGS. 1*a*-1*c*, 2*a*-2*c*, and generally FIG. 3*a*, FIG. 3*b*, through FIG. 4, a tool 10 is depicted having a head 12 having anchor means 20 formed thereon. The head 12 may also include a radius 18 formed along an outer perimeter of the head 12.

In accordance with FIGS. 1*a*-1*c*, FIGS. 3*a*, 3*b*, and FIG. 4, anchor means 20 is positioned non-concentric in relation to the head 12 configuration and the radius 18 formed along the head 12 perimeter, whereby concentric along the head 12 and relative to the radius 18 is denoted by CC (the intersection of lines HC-HC and LC-LC). Means for rotating 30 the head 12 may be included for urging rotation of the head 12 about anchor means 20, either through manual input or mechanical input.

In accordance with FIGS. 2*a*-2*c*, and as an alternative embodiment to FIGS. 1*a*-1*c*, the head 12 comprises an oval-shaped configuration (in contrast to the substantially circular configuration of FIGS. 1*a*-1*c* and FIGS. 3*a* and 3*b*), wherein anchor means 20 is positioned concentric in relation to the oval-shaped head 12 with the anchor means 20 centered equidistant from the terminal edges of the long-diameter (dl) and equidistant from the terminal edges of the short-diameter (ds) of the head 12. It is envisioned that anchor means 20 comprises a one-half (0.5) inch first bore 20*a* disposed at the center of the head 12 and to a depth of approximately $3/8^{th}$ inch and having a square-shaped configuration adapted to accommodate the square-shaped drive stud of a standard drive ratchet. Subjacent the first bore 20*a* is a second bore 20*b* having an upper terminus end co-terminus with the lower end of the first bore 20*a* and terminating at a lower terminus punching through the opposite side or face of the head 12. The second bore 20*b* includes a cylindrical configuration adapted to accommodate a mechanical fastener (e.g., threaded screw; nail) therethrough for temporarily anchoring the head 12 to the subsurface of the floor or wall upon which flooring, siding, or other similar material is being installed. Once the mechanical fastener is inserted through the second bore 20*b* and secured to the surface, the drive stud of a ratchet may be inserted into the first bore 20*a*, with the ratchet controlling the clockwise or counterclockwise rotational movement of the head 12 for engaging the edge of the flooring or siding. It is preferred that the tool 10 is placed in proximity to the flooring or siding with the long-diameter (dl) approximately parallel to the edge of the flooring or siding.

In one embodiment, as depicted in FIG. 3*a*, FIG. 3*b*, and FIG. 4, a tool 10 comprises a body 11 having a head 12, a base 16, and a lever 14 intermediately disposed between the head 12 and the base 16. Generally, the head 12 has a radius 18. The head 12 also includes anchor means 20 formed on the head. The tool 10 is reversible, with the obverse and reverse sides of the tool 10 being mirror images of one another but allowing a user to change the positioning of the tool 10 if demanded because of space constraints.

The lever 14 is disposed between the head 12 and base 16 to transfer any force/work input at the base 16. The lever 14 can be formed or shaped into a variety of arrangements, including curvilinear forms (as depicted in FIG. 2 or FIG. 4). It is additionally contemplated that the lever 14 can be linear in shape or form.

The radius 18 may include a channel 22 formed therein. The channel 22 comprises a floor 22*a* intermediately disposed between and bounded by a first side wall 22*b* and a second side wall 22*c*. The sidewalls 22*b* and 22*c* may be angled (as depicted) or substantially perpendicular to the floor 22*a*. The channel 22 may be formed at a variety of depths consistent with the length of the tongue-portion of a tongue-and-groove flooring or siding section. In particular, the channel 22 depth should not exceed the distance from the outermost edge of the tongue to the sidewall(s) of the flooring/siding section.

The channel 22 may also comprise a front ramp 22*d* and/or a rear ramp 22*e*. In one embodiment, a front ramp 22*d* is in mechanical relationship with the one terminal end of the floor 22*a*, and side walls 22*b* and 22*c*. In another embodiment, the front ramp 22*d* deflects downward from rear to front to accommodate receipt of the tongue-portion of a tongue-and-groove section of flooring or siding. In another embodiment, the channel 22 also includes a rear ramp 22*e* formed at the opposing end of the channel 22 forming a mechanical relationship with the opposing terminal ends of floor 22*a* and sidewalls 22*b* and 22*c*. It is envisioned that the rear ramp 22*e* may deflect downward (from rear to front) to further accommodate ease of removal from the tongue-portion of a flooring or siding section, or may deflect upward (from rear to front) to promote additional security in coupling with the tongue-portion (if desired).

Anchor means 20 (formed on head 12) is positioned non-concentric in relation to the radius 18 (and non-concentric within head 12), as indicated by the bisecting centerlines depicted in FIG. 2 (LC-LC and HC-HC), with CC denoting the concentric center relative to the radius 18. By positioning anchor means 20 non-concentric to the radius 18, the head 12 may be rotated along anchor means 20 thereby increasing or decreasing the distance between the anchor means 20 and the point-of-contact along the radius 18. Increasing the distance between anchor means 20 and the point-of-contact along the radius 18 reduces the force applied, and conversely, decreasing the distance between anchor means 20 and the point-of-contact along the radius 18 increases the force applied, and will be discussed in additional detail below (in connection with FIG. 10 and FIG. 11).

Anchor means 20 may comprise an aperture adapted to receive a mechanical fastener suitable for securing the tool 10 to a surface (e.g., subflooring; wall stud). It is also envisioned that anchor means 20 may comprise an aperture with internal threading adapted to receive a threadable spike for securing the tool 10 to a surface. It is also envisioned that a permanent spike may be used to replace the threaded shaft with a permanent coupling to the anchor means 20.

Figure 9:
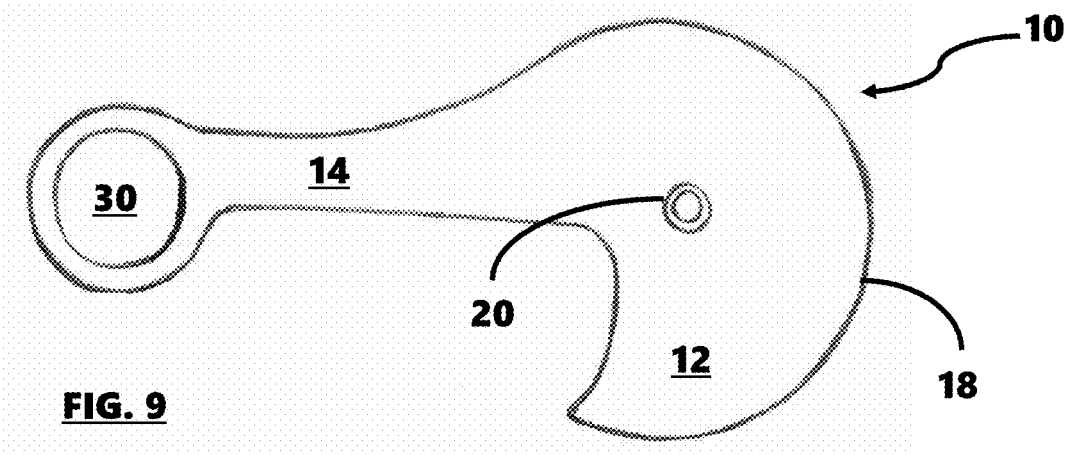
FIG. 9 depicts a plan view of another embodiment of the tool without cut-out sections or portions.

The head 12 may be partially cut (FIG. 1), substantially cut (FIG. 2), or substantially uncut (FIG. 9). In the cut embodiments, e.g., FIG. 1 and FIG. 2, the material is removed to reduce the weight of the tool 10 and to save on material usage. As depicted in the figures, the head 12 may include a hook-shaped end 40. It is envisioned that the hook-shaped end 40 will allow the user to hang the tool 10 from any suitable article, including a tool-belt, pocket, beam, rung, or other similar items.

Generally, the base 16 is used to rotationally urge the head 12 to turn about the anchor means 20. The base 16 may be manually or mechanically urged so that energy/work input through the base 16 is transmitted up through the lever 14 into the head 12 and translated to cause the head 12 to rotate about anchor means 20.

Figure 5:
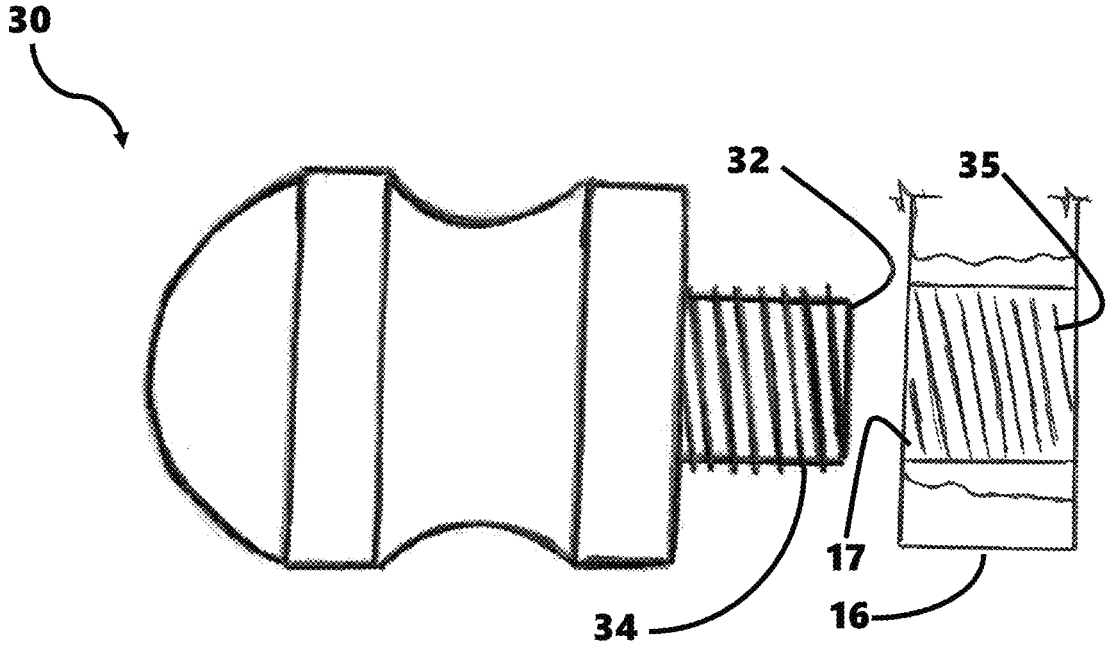
FIG. 5 depicts an embodiment of a handle having a threaded member that is threadably mateable with the threads formed in the base of the tool.

The base 16 may include a cavity or other opening 17 adapted to receive and hold a grip 30. In one embodiment, consistent with FIG. 5, the grip 30 includes a rod 32 with external threading 34 complementary to internal threads 35 formed within the cavity or opening 17 within the base 16 portion of the tool 10, thereby allowing the user to thread and unthread the grip 30 for placement or displacement as desired. The additional height of the grip 30 provides additional grasping area for the user when applying manual pressure, while also providing additional surface area and reinforcement to the base 16 if the user elects to apply mechanical force (e.g., striking with a mallet or hammer). In such an arrangement, it is further envisioned that the cavity 17 has complementary threading along the obverse and reverse sides of the tool 10 so that the grip 30 might be threaded on either side of the tool 10 if desired.

Figure 6:
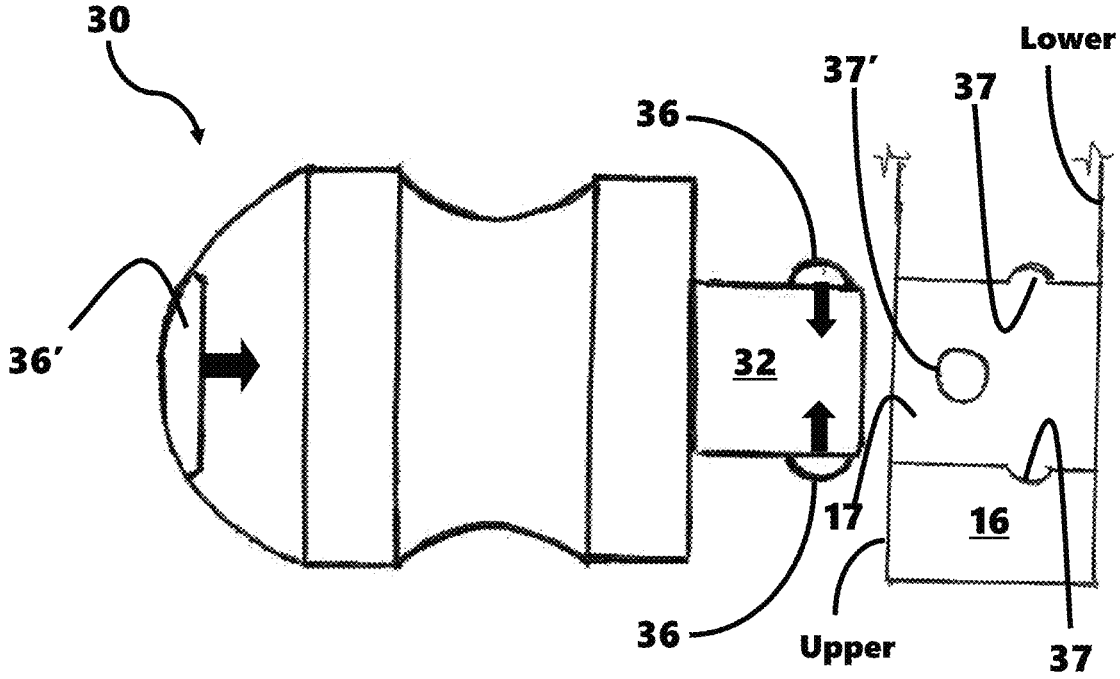
FIG. 6 depicts an embodiment of a handle having a stem with outwardly biased bearings that align with dimples formed in the base of the tool.

Consistent with FIG. 6, the grip 30 includes a rod 32 with at least one outwardly biased bearing 36, the bearing(s) 36 urged into one or more dimples 37 formed on the inside of the opening or cavity 17 of the base 16, thereby securing and/or locking the grip 30 within the opening/cavity 17. As more particularly illustrated in FIG. 9, the grip 30 includes a pair of outwardly biased bearings 36 that align with the pair of dimples 37 formed within the cavity 17 when the grip 30 is inserted through the upper side of the tool 10. The grip 30 also includes a pair of dimples 37' formed with the cavity 17 approximately 90 degrees in relation to the dimples 37, with the bearings 36 aligned with dimples 37' when the grip 30 is inserted through the lower side of the tool 10. The bearing(s) 36 is/are in mechanical communication with a button 36', wherein depressing the button 36' (moving the button 36' within the grip 30 structure) releases the spring(s) and removes the outward bias of the bearing(s) 36 and allows the grip 30 to be removed from the opening/aperture within the base 16 (as generally denoted by the directional arrows in FIG. 6).

Figure 7:
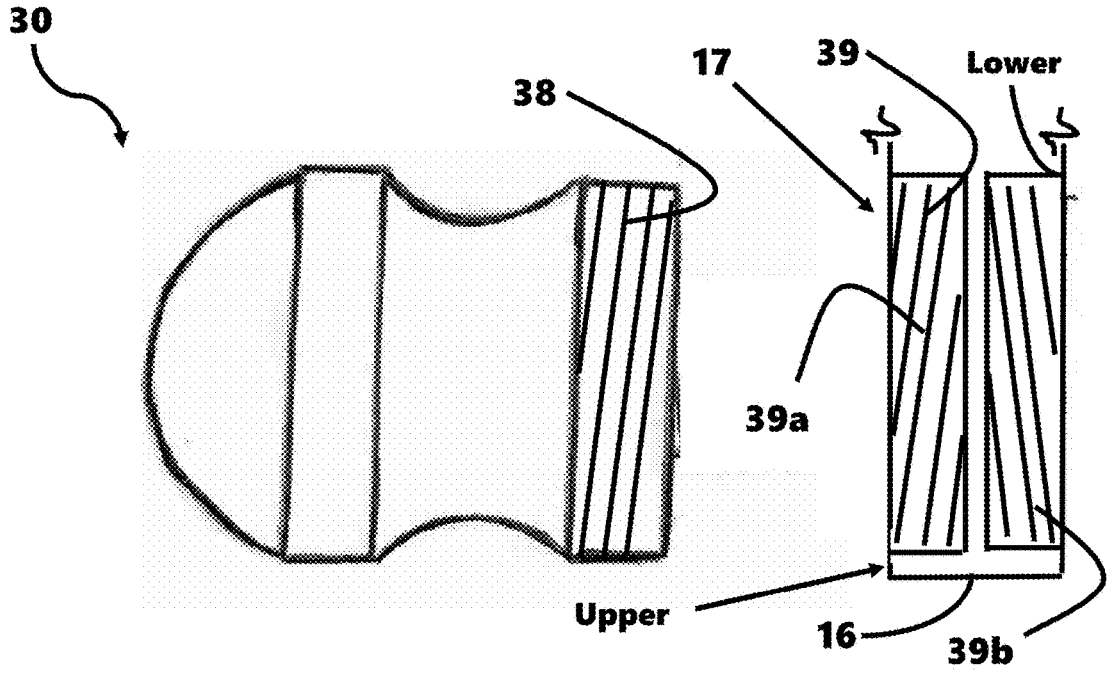
FIG. 7 depicts an embodiment of a handle having threads at or near the floor of the handle that are threadably mateable with threads formed in the base of the tool.
Figure 10:
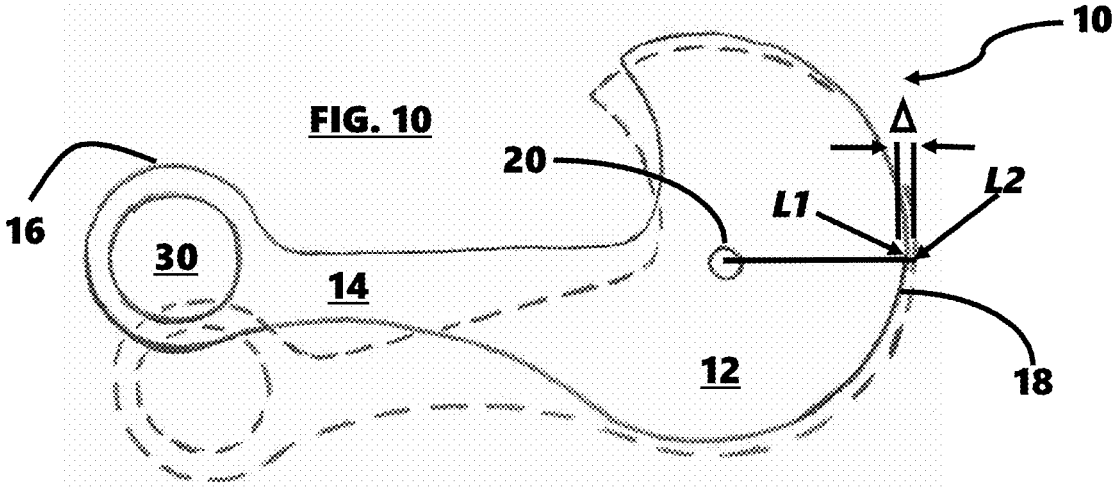
FIG. 10 depicts a plan view of the tool head advancing in a counterclockwise rotational motion, indicating increasing distance between anchor means and the point-of-contact along the radius.

In another embodiment, consistent with FIG. 7, the grip 30 includes external threading 38 adjacent the circumferential perimeter floor and that is complementary to internal threading 39 provided within the cavity 17 formed in the base 16 of the tool 10. As also illustrated in FIG. 10, in another embodiment, the cavity 17 includes an upper internal thread set or grouping 39*a* and a lower internal thread set or grouping 39*b*, whereby the external threading 38 may be threadable mated with either set or grouping 39*a* or 39*b* depending on which side of the tool 10 the user wishes to utilize. Thus, the upper set or grouping 39*a* is accessed on the upper side of the tool 10 and the lower set or grouping 39*b* is accessed on the lower side of the tool 10 (opposite to the upper side). It is further envisioned that the cavity 17 may be separated into an upper cavity (corresponding with the upper side of the tool 10) and a lower cavity (corresponding with the lower side of the tool 10).

Figure 8:
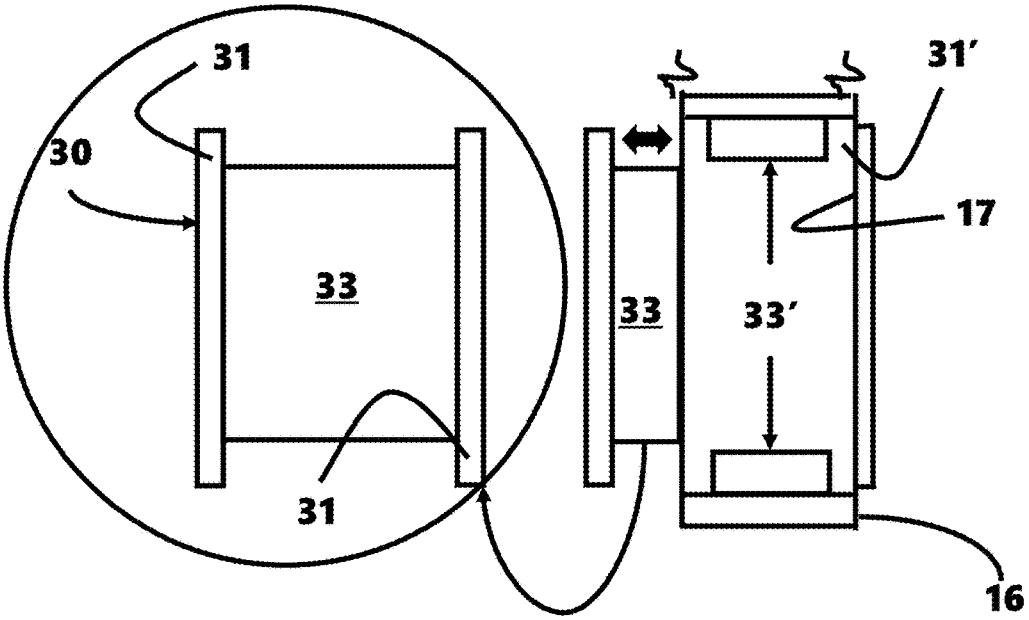
FIG. 8 depicts an embodiment of a handle having an axle or cylinder with flanges at opposing ends that moves within a cavity having a bore or void that accommodates the axle or cylinder and recess formed on either side of the bore or void to accommodate the flanges therein.

In another embodiment, consistent with FIG. 8, the length or height of the grip 30 is two-times the measured width of the base 16, and the cavity 17, wherein the grip 30 is permanently secured through the base 16 and movable between either side of the tool 10 as desired, providing the striker surface if the user reverses the tool 10. In this embodiment, the grip 30 includes a pair of flanges 31 formed on opposing ends or sides of the axle or cylinder 33 of the grip 30, the flanges 31 each having a diameter wider than the axle or cylinder 33. The cavity 17 includes a bore or void 33' having a dimension accommodating the dimension of the axle or cylinder 33, with the bore or void 33' having a pair of recesses 31' formed on opposing sides or ends of the bore or void 33' and having dimensions accommodating the flanges 31 of the grip 30.

Figure 11:
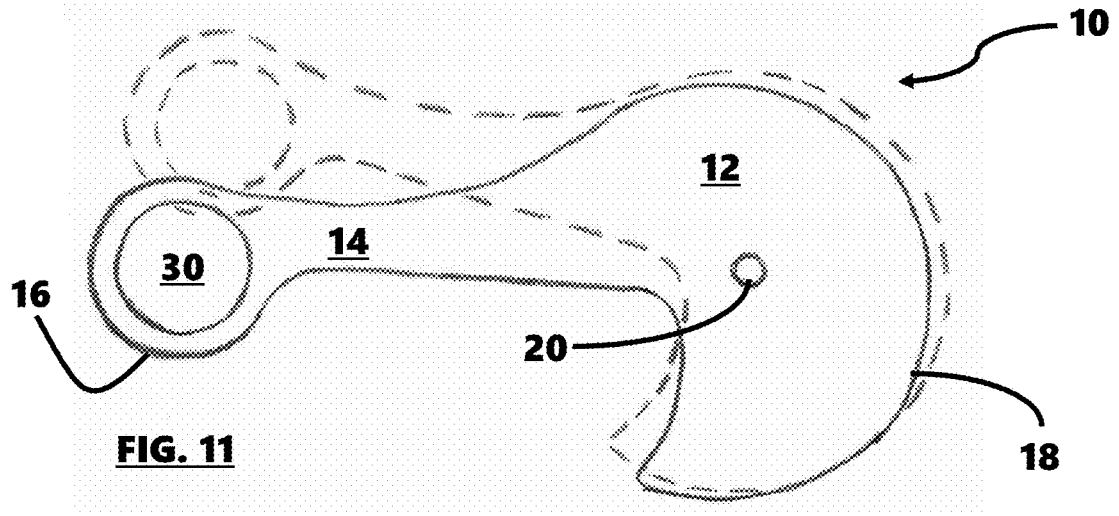
FIG. 11 depicts a plan view of the tool head flipped-over and advancing in a clockwise rotational motion indicating increasing distance between anchor means and the point-of-contact along the radius.

As depicted in FIGS. 9-11, in an embodiment that includes a solid body (without cut-outs), the tool 10 is also depicted as anchored via means 20 and rotated either counterclockwise (FIG. 10) or clockwise (FIG. 11), and illustrating the manner in which the tool 10 engages or releases the targeted article, whether flooring or siding, and more particular, an edge of the flooring or siding.

In FIG. 10 and FIG. 11, the starting point-of-contact between the flooring or siding (not shown) and the tool 10 and the head 12 (particularly along the radius 18 and the channel 22 formed thereon) is denoted by the arrowhead with the length denoted by L1. The tool 10 is urged counterclockwise, whereby the handle 16 is urged from a starting position to a counterclockwise position (indicated by dashed-lines), thereby increasing the length between the point-of-contact and the anchor means 20 (the increased length denoted by L2). The increased length (from L1 to L2) indicates that the tool 10 is moving the flooring or siding into a position that is closer to ideal (as close to straight as is achievable with pliable material). FIG. 11 illustrates the tool 10 flipped-over and utilizing the reverse side, and with the clockwise rotation achieving the same urging as that depicted in FIG. 10, thereby urging the flooring or siding into a relatively straightened position. If a user reverses the rotation in either (or both) of FIG. 10 and/or FIG. 11, the distance is decreased, thereby reducing the pressure placed on the flooring or siding.

Figure 12:
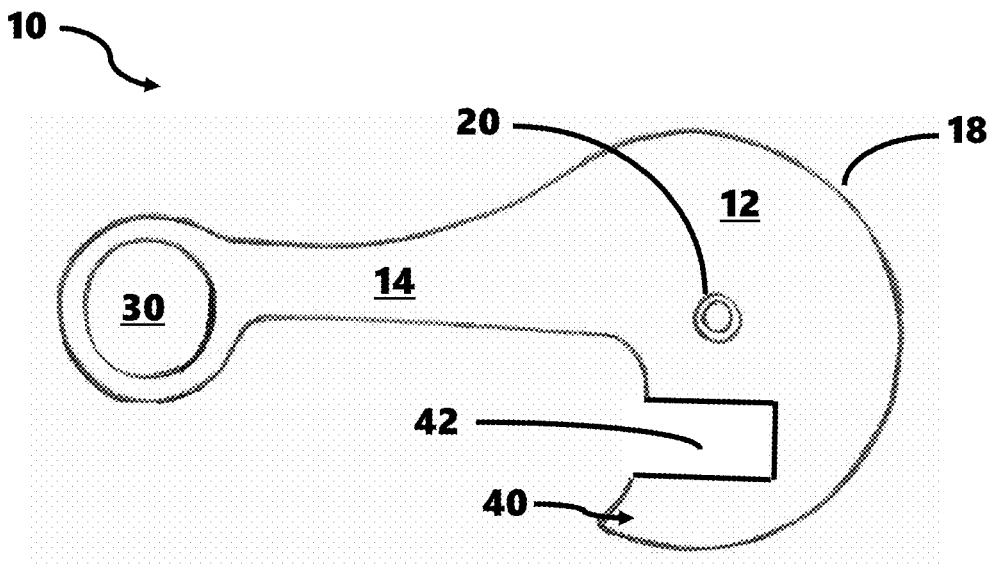
FIG. 12 depicts a plan view of the tool including a slot for suspending the tool from an object or article.
Figure 13:
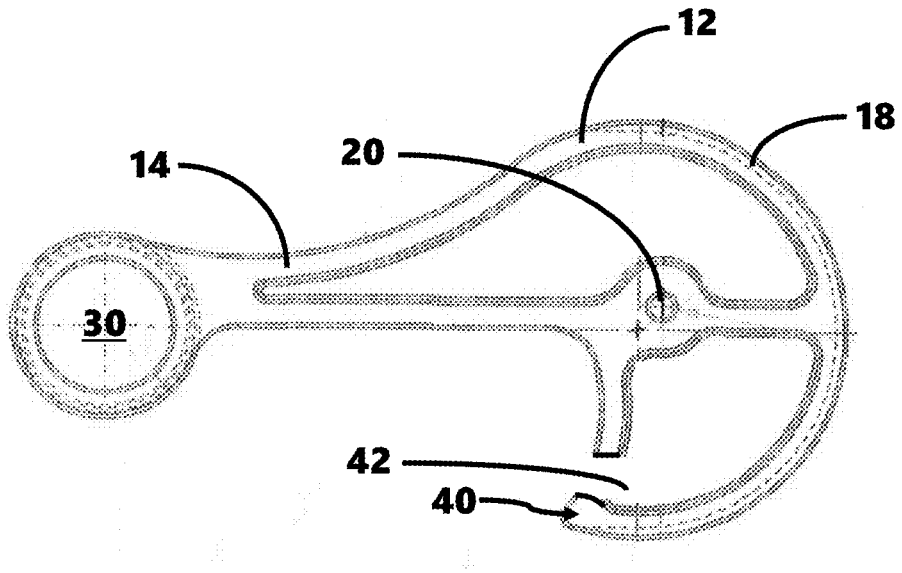
FIG. 13 depicts a plan view of the tool including cut-outs and a slot for suspending the tool from an object or article.

In another embodiment, consistent with FIG. 12 and FIG. 13, the tool 10 is depicted with either a solid body (FIG. 12) or a cut-out body (FIG. 13) and including a slot 42 formed in the head 12. The slot 42 is formed in the head and disposed near the hook-shaped end 40, the slot 42 including at least an opening allowing a catch or similar object to insert therethrough and act as a suspension support for holding and retaining the tool 10 via the slot 42 formed therein.

It is to be understood that the embodiments and claims are not limited in application to the details of construction and arrangement of the components set forth in the description and/or illustrated in drawings. Rather, the description and/or the drawings provide examples of the embodiments envisioned, but the claims are not limited to any particular embodiment or a preferred embodiment disclosed and/or identified in the specification. Any drawing figures that may be provided are for illustrative purposes only, and merely provide practical examples of the invention disclosed herein. Therefore, any drawing figures provided should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations.

Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

What is claimed is:

1. A tool comprising:

a head having a radius, the radius including a channel formed therein, wherein the channel comprises a floor intermediately disposed between a first side wall and a second side wall, and wherein the channel further comprises a ramp in communication with the floor and the first and second side walls;

anchor means eccentric to the radius formed in the head; and, a lever depending from the head.

2. The tool of claim 1 further comprising a base depending from the lever, the base including a cavity and a grip selectively attachable and detachable within in the cavity.

3. A tool comprising:

a body having a head, a base, and a lever intermediately disposed between the head and the base;

a radius formed along the head;

a channel formed within the radius, wherein the channel comprises a floor intermediately disposed between a first side wall and a second side wall, and wherein the channel further comprises a front ramp in communication with the floor and the first and second side walls; and anchor means formed on the head and eccentric to the radius.

4. A tool comprising:

a body having a head, a base, and a lever intermediately disposed between the head and the base;

a radius formed along the head;

a channel formed within the radius, wherein the channel comprises a floor intermediately disposed between a first side wall and a second side wall, and wherein the channel further comprises a rear ramp in communication with the floor and the first and second side walls; and anchor means formed on the head and eccentric to the radius.

5. A tool comprising:

a body having a head, a base, and a lever intermediately disposed between the head and the base;

a radius formed along the head;

a channel formed within the radius; and anchor means formed on the head and eccentric to the radius, wherein anchor means comprises an aperture for securing the tool to a surface via a fastener.

6. A tool comprising:

a body having a head, a base, and a lever intermediately disposed between the head and the base, wherein the base comprises a cavity, the cavity including a plurality of threads;

a grip selectively attachable and detachable to the cavity, the grip including a plurality of threads, wherein, the plurality of threads of the cavity and the plurality of threads of the grip are threadably mated and unmated to provide selective attachment and detachment of the grip and the cavity;

a radius formed along the head;

a channel formed within the radius; and anchor means formed on the head and eccentric to the radius.

7. A tool comprising:

a body having a head, a base, and a lever intermediately disposed between the head and the base, wherein the head comprises a hook-shaped end;

a radius formed along the head;

a channel formed within the radius; and anchor means formed on the head and eccentric to the radius.

8. The tool of claim 7, wherein the head comprises a slot formed near the hook-shaped end.

9. A tool comprising:

a body having a head, a base, and a lever intermediately disposed between the head and the base, wherein the lever is curvilinear relative to the head;

a radius formed along the head;

a channel formed within the radius; and anchor means formed on the head and eccentric to the radius.

* * * * *